US006920773B2

(12) United States Patent
Leiponen

(10) Patent No.: US 6,920,773 B2
(45) Date of Patent: Jul. 26, 2005

(54) METHOD AND APPARATUS FOR MANUFACTURING TUBES BY ROLLING

(75) Inventor: Matti Leiponen, Helsinki (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/450,425

(22) PCT Filed: Dec. 11, 2001

(86) PCT No.: PCT/FI01/01075

§ 371 (c)(1),
(2), (4) Date: Jun. 11, 2003

(87) PCT Pub. No.: WO02/055226

PCT Pub. Date: Jul. 18, 2002

(65) Prior Publication Data

US 2004/0035165 A1 Feb. 26, 2004

(30) Foreign Application Priority Data

Dec. 20, 2000 (FI) ..... 20002797

(51) Int. Cl.[7] ..... B21B 9/00
(52) U.S. Cl. ..... 72/38; 72/96; 72/98
(58) Field of Search ..... 72/38, 96, 97, 72/98, 99, 100, 69, 110, 236

(56) References Cited

U.S. PATENT DOCUMENTS 4,318,294 A * 3/1982 Yoshiwara et al. ..... 72/97
4,578,974 A * 4/1986 Pozsgay et al. ..... 72/97
4,722,209 A * 2/1988 Mankins ..... 72/38
4,727,747 A * 3/1988 Naud et al. ..... 72/38
4,738,128 A * 4/1988 Staat ..... 72/96
4,928,507 A * 5/1990 Staat et al. ..... 72/38
6,651,473 B2 * 11/2003 Roller ..... 72/69

FOREIGN PATENT DOCUMENTS

DE 2929401 * 2/1981 ..... B21B/9/00

* cited by examiner

*Primary Examiner*—Ed Tolan
(74) *Attorney, Agent, or Firm*—Smith-Hill and Bedell

(57) ABSTRACT

A method for manufacturing a tube made of a non-ferrous material, particularly a tube made of mainly copper, by rolling, in which method, in the first working step the tube billet is worked by rolling with conical rolls, so that mainly owing to the deformation resistance, the temperature of the billet under operation rises up to the recrystallization range, at least on the spot that is being worked. Essentially immediately after the first working step, the tube billet is subjected to at least one second working step with a second set of conical rolls, in which case the tube billet is maintained, at least during the first working step and at least a second working step in non-oxidizing conditions. The invention also relates to an apparatus.

24 Claims, 3 Drawing Sheets

METHOD AND APPARATUS FOR MANUFACTURING TUBES BY ROLLING

This is a national stage application filed under 35 USC 371 based on International Appplication No. PCT/FI2001/01075 filed Dec. 11, 2001, and claims priority under 35 USC 119 of Finnish Patent Application No. 20002797 filed Dec. 20, 2000.

The present invention relates to a method and apparatus for manufacturing tubes by rolling.

Figure 1:
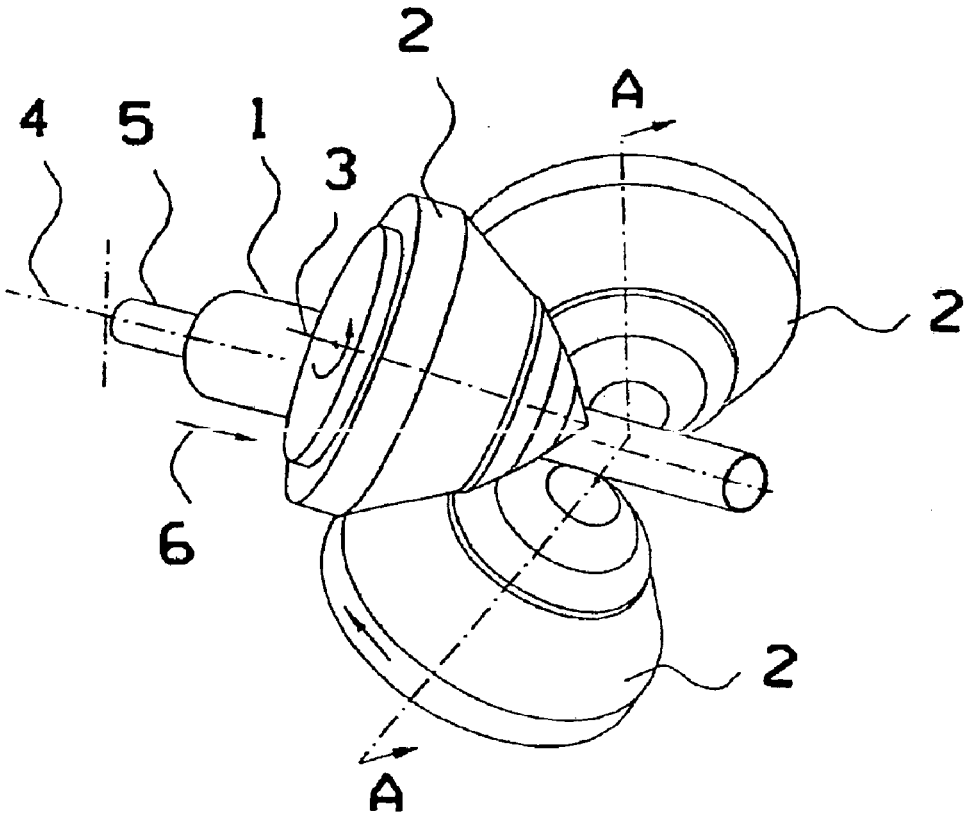

From the U.S. Pat. No. 4,876,870, there is known a method for manufacturing tubes of a non-ferrous metal, where a continuously cast billet is cold worked for instance by planetary rolling, so that owing to the influence of deformation resistance, the temperature of the worked material rises to the recrystallization range. In said publication, cold working generally means a process where the temperature of the billet under operation is normal when starting the working, but rises along with the process essentially higher than in an ordinary cold working operation, i.e. up to the recrystallization range of the material. A planetary rolling arrangement is disclosed in the U.S. Pat. No. 3,735,617, where three conical rolls are arranged at angles of 120° with respect to each other. The rolls rotate both around their own axis and around the center of the planetary housing. In said arrangement, the mainly conically narrowing shape of the rolls is essentially narrowed in the proceeding direction of the material to be rolled. There are also known corresponding arrangements where the rolls are arranged in a reversed position with respect to the proceeding direction of the rolled material, in which case their conical shape is narrowed against the proceeding direction of the material to be rolled. The U.S. Pat. No. 4,510,787 introduces a method for manufacturing hollow rods, where one possibility is to employ mainly conical rolls that are narrowed in an opposite direction than the proceeding direction of the rolled material. From the GB application 2019281 A, there also is known a planetary mill where the axes of the rolls are parallel with the proceeding direction of the tube billet to be rolled. Yet another arrangement known in the prior art is illustrated in FIG. 1.

Copper tubes have been manufactured extremely successfully by using the method of the prior art. However, if production capacity should be increased, the current method and particularly the employed equipments have some drawbacks. An increase in the production capacity reguires an increase in the rolling speed. The structures of current planetary rolling mills, particularly the structures of the roller heads, are ill suited to increasing the rolling speed and the rolling mill rotation speed. This is due to forces required to hold the roller heads in position during their rotation, among others.

The object of the invention is to realize a method whereby production capacity can be increased economically. Another object of the invention is to realize an apparatus whereby the drawbacks of the prior art can be avoided and production capacity increased according to the method of the invention.

The invention is based on the observation that the working resistance of copper is diminished to a fraction after recrystallization. This enables an extremely economical further rolling, with an equipment that is remarkably more economical than in the first working step.

The method according to the invention has several remarkable advantages. The division of the working process into two steps enables, among others, after the first working step, a larger wall thickness of the tube billet than in the prior art, which results in an increase in the production capacity. By means of the method and apparatus of the invention, production rates can be increased even two or three times in comparison with the prior art. The working of the tube billet—which is in the first working step recrystallized and softened mainly due to rolling—by rolling immediately after the first working step only requires a slight amount of power in the second working step. When both working steps are carried out in a protective gas chamber, harmful effects of oxidation, particularly in a copper-containing tube billet, are prevented during the working process.

In the present application, a conical roll generally means a rolling mill roll with a diameter that is at the first end of the rolling surface larger than at the second end. The true shape of the conical roll does not necessarily have to be conical or frusto-conical, but it can be varied according to the particular embodiment. Planetary rolling generally means rolling where the rolls rotate both around their own axis and around the billet to be rolled.

Figure 2:
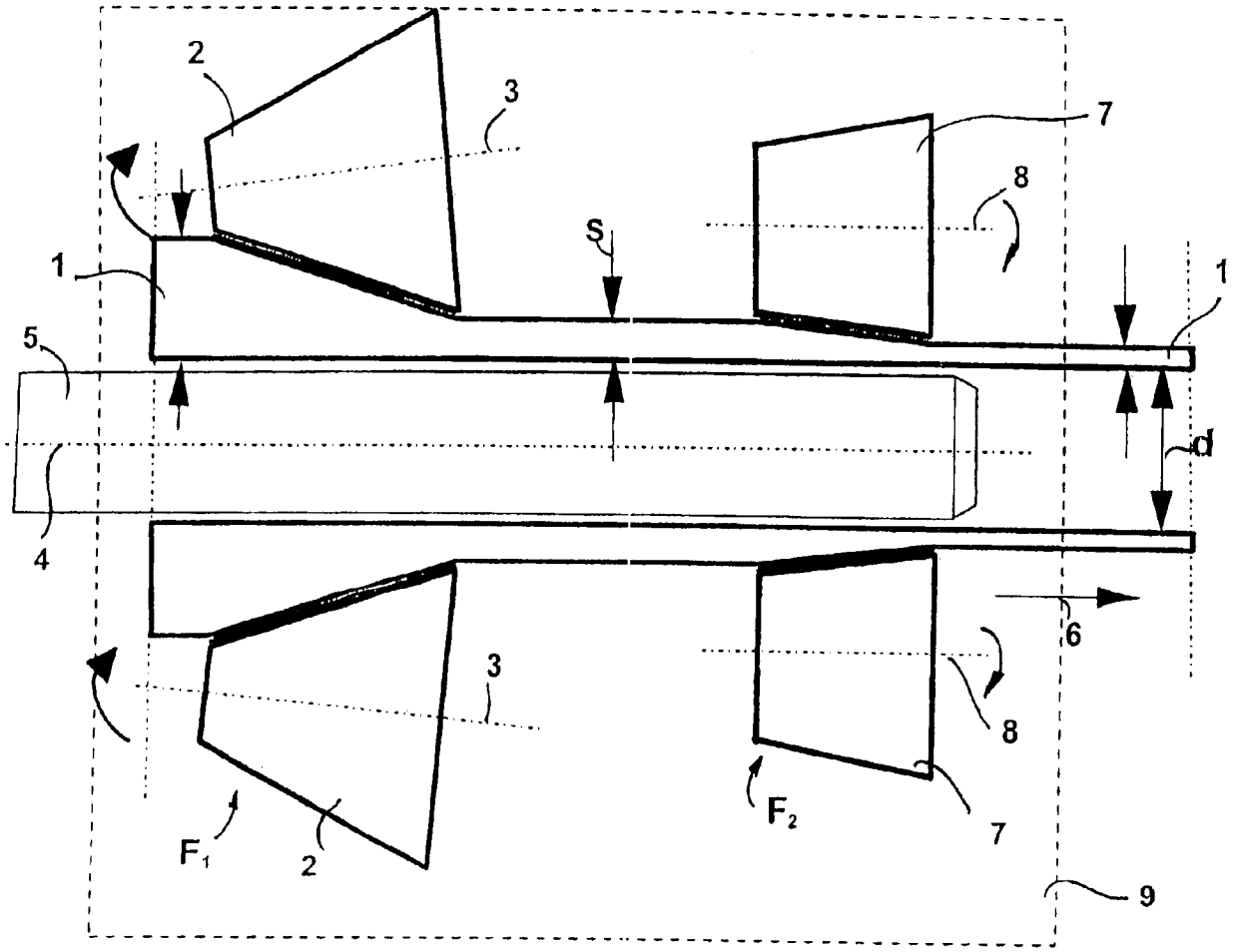
Figure 3:
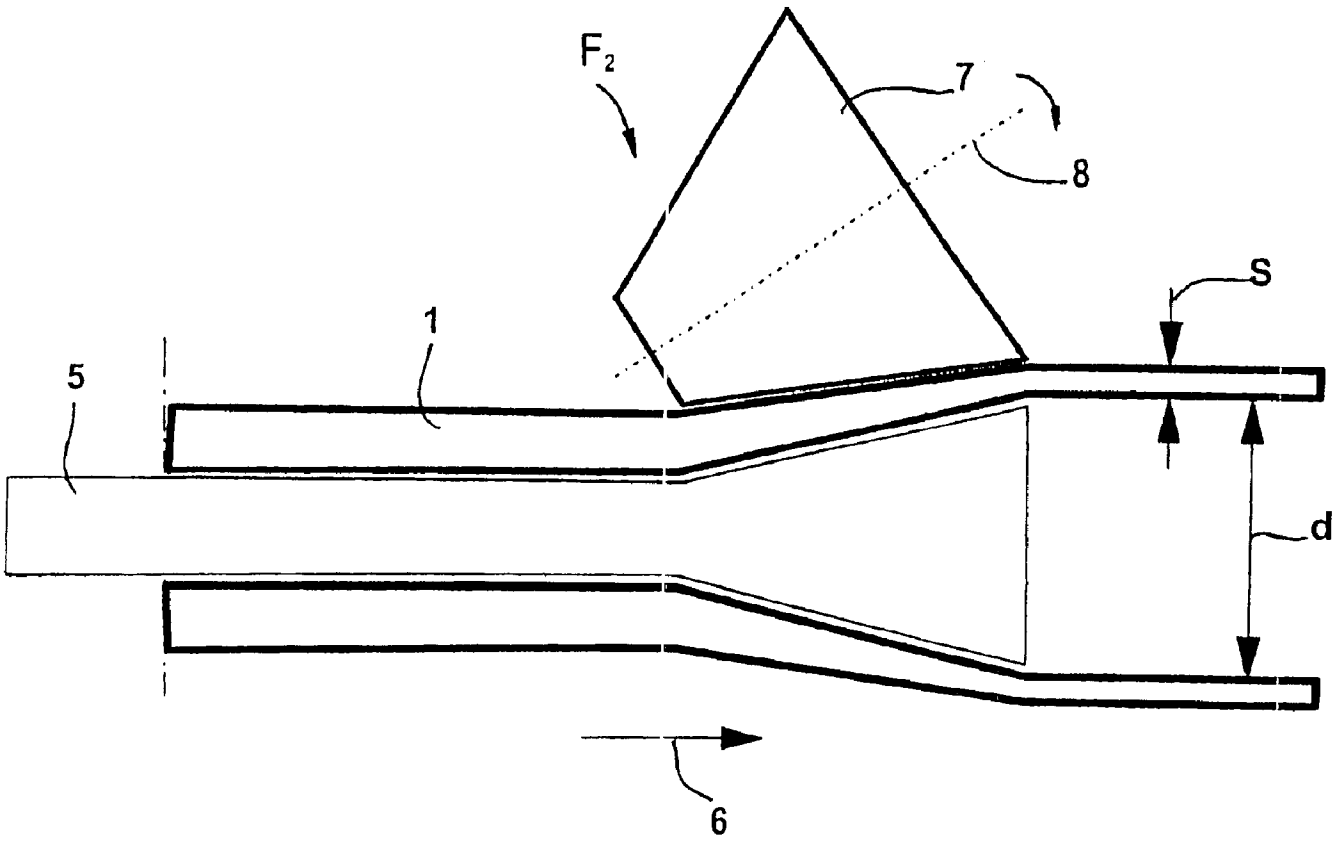

The invention is explained in more detail below by way of an example and with reference to the appended drawings, where FIG. 1 is a simplified illustration of a prior art tube rolling step, FIG. 2 is a simplified illustration of an embodiment according to the invention, and FIG. 3 illustrates a detail of an embodiment according to the invention.

FIG. 1 illustrates a prior art solution for working a tube billet 1 by rolling. In the prior art arrangement, the tube billet 1 is planetary rolled in one working step mainly with conical roll elements 2, which will be called conical rolls in the text below. Each of the conical rolls 2 rotates around its rotary axis 3, and in addition, the rolls typically rotate essentially around the rotary axis of the planetary housing, which axis is parallel to the central axis 4 of the tube billet. During rolling, there is typically used a mandrel 5 inside the tube billet. In the drawing, the motional direction of the tube billet is indicated by the arrow 6. For the sake of clarity, the moving and drive gear of the conical rolls 2 is left out of the drawing. Some typical rolling arrangements utilizing conical rolls are disclosed for instance in the publications U.S. Pat. No. 3,735,617 and GB 2019281 A.

FIG. 2 is a simplified illustration of an embodiment according to the method of the present invention, shown in cross-section along the line A—A of FIG. 1. Accordingly, for example a continuously cast tube billet 1 is brought to a working step according to the invention. In the first working step $F_1$ of the method, the tube billet 1 is worked, advantageously cold worked, by rolling the conical rolls so that the temperature or the tube billet to be worked rises, mainly owing to the influence of deformation resistances, up to the recrystallization range or in the vicinity thereof, at least in the spot that is being worked. The first working step $F_1$ is carried out by a first rolling mill device. The first rolling mill device includes at least one, preferably several mainly conical rolls 2. In the embodiment of FIG. 2, the conical rolls 2 rotate around their axis 3 and also around the center of the planetary housing, for instance, which housing is typically located on the central axis 4 of the tube billet 1. Inside the tube billet 1, there is typically employed a mandrel 5, in which case the wall of the tube billet 1 is worked between the rolls 2 and the mandrel 5. Typically, in the first working step, the degree of working, the wall thickness of the tube billet under operation and the mass flow are chosen so that there is achieved a maximum mass flow, and that there are good conditions for recrystallization.

Essentially immediately after the first working step $F_1$, the tube billet is subjected to a second working step $F_2$, typically by rolling with a second set of conical rolls 7. At least during the first working step $F_1$ and the second working step $F_2$, and advantageously also between said working steps, the tube billet 1 is kept in non-oxidizing conditions. Said non-oxidizing conditions are created for instance by means of a protective gas space 9, where the conditions are adjusted in order to at least partly prevent the oxidation of the tube billet. The employed protective gas can typically be for example nitrogen or argon.

According to a preferred embodiment of the method according to the invention, in the second working step $F_2$ the wall thickness s of the tube billet 1 is diminished. Typically the wall thickness of the tube billet (1) is diminished for about 50–70% in the second working step $F_2$. The second working step $F_2$ may comprise several successive rolling steps. In a typical embodiment, in the second working step $F_2$ the tube billet 1 is worked by planetary skew rolling or planetary cross-rolling with conical rolls. In another embodiment, in the second working step $F_2$ the tube billet 1 is worked by stretch reducing. In a third embodiment, the tube billet is worked by applying sizing rolling. The second working step may comprise several successive rolling operations. Different types of working processes can also be combined in succession.

The method according to the invention provides wider possibilities for working than the prior art. In the second working step $F_2$, the (inner) diameter d of the tube can be maintained essentially constant. In another preferred embodiment, the tube diameter d is enlarged in the second working step $F_2$ (FIG. 3). The tube diameter d is enlarged by using, when necessary, a mandrel 5 inside the tube billet. In FIG. 3, the diameter of the mandrel 5 is enlarged at the second working spot conically towards the exit direction 6 of the tube billet. In a typical case, the wall thickness s of the tube billet is simultaneously diminished. In a preferred embodiment, the tube billet diameter d can also be diminished in the second working step $F_2$.

In the method according to the invention, the (inner) diameter d and the wall thickness s of the tube billet 1 can be adjusted to the desired measures in a way that is remarkably more flexible than those used in the prior art.

When necessary, the temperature of the tube billet 1 is adjusted, either prior to the first working step, during it, prior to the second working step or during it. Heating can be carried out for instance by using an induction coil. Naturally the billet can also be cooled in order to obtain the desired processing temperature in the tube billet.

The apparatus according to the invention for working the tube billet comprises in the first working step $F_1$ a rolling mill arrangement with at least one conical roll element 2. Essentially immediately after the rolling arrangement of the first working step $F_1$, in the proceeding direction 6 of the tube billet 1, there is arranged the rolling arrangement of the second working step $F_2$. The apparatus includes means for creating non-oxidizing conditions that protect the tube billet 1, said means being for example a protective gas space 9, at least at the first working step $F_1$ and the second working step $F_2$ of the rolling arrangement and advantageously also therebetween.

Typically the protective gas space 9 surrounds, at least partly, the rolling arrangement of both the first and the second working step, and also the space provided in between, at least in the vicinity of the tube billet 1. Obviously the apparatus typically also comprises means for conducting the protective gas to the protective gas space and for maintaining a sufficient protective gas content in said protective gas space.

In a typical embodiment, the diameter of the roll element of the rolling arrangement of the first working step $F_1$ is larger on the input side of the tube billet than on the output side (as is seen in FIG. 1). According to another embodiment, the diameter of the roll element 2 of the first rolling arrangement is larger on the tube billet output side than on the tube billet input side (according to FIG. 2). Typically the first rolling arrangement is a planetary mill with at least three conical roll elements 2 provided as the employed rolling elements.

In the embodiment of FIG. 2, at least one of the rolling arrangements of the second working step $F_2$ is a planetary mill.

In a preferred embodiment, the rotary axis 8 of the roll 7 of the rolling arrangement of the second working step is parallel to the longitudinal axis 4 of the tube billet 1.

Typically the rotary axis 8 of at least one roll 7 of the rolling arrangement of the second working step forms an angle with the longitudinal axis 4 of the tube billet.

In an embodiment, the rotary axis 8 of at least one roll 7 of the rolling arrangement of the second working step is essentially perpendicular to the plane that is tangential to the longitudinal axis 4 of the tube billet 1.

Thus the roll arrangement of the rolling apparatus of the second working step can consist of conical roll elements, or roll elements with rotary axes that are perpendicular to the proceeding direction of the tube billet, or of a combination of these.

The apparatus comprises at least one mandrel element 5. The shape and size of said mandrel element depends on the embodiment in question. FIG. 3 illustrates an embodiment where the (inner) diameter d of the tube billet 1 is enlarged. At the same time, the wall thickness s of the tube billet 1 is diminished. The diameter of the mandrel 5 is enlarged conically at the working spot towards the output direction 6 of the tube billet 1.

The invention is mainly suited to the manufacturing of tubes made of a non-ferrous material. In particular, the invention is designed to the manufacturing of copper or copper alloy tubes.

What is claimed is:

1. A method for manufacturing a tube made of a non-ferrous material, comprising:

feeding a tube billet in predetermined feeding direction through a first rolling station and a second rolling station, wherein the second rolling station downstream of the first rolling station with respect to the feeding direction of the tube and the second rolling station is so located relative to the first rolling station that simultaneously a first length segment of the tube billet is located in the first rolling station and a second length segment of the tube billet is located in the second rolling station and a length segment of the tube billet that leaves the first rolling station substantially immediately enters the second rolling station, working the tube billet in the first rolling station by rolling with conical rolls, so that mainly owing to deformation resistance, the temperature of the billet under operation rises up to the recrystallization range, at least on the working spot, working the tube billet at the second rolling station by rolling with a second set of conical rolls, and keeping at least the first and second length segments of the tube billet in non-oxidizing conditions.

2. A method according to claim 1, wherein the second length segment of the tube billet is separated from the first length segment of the tube billet by a third length segment that is between the first and second rolling stations, and the method comprises keeping the third length segment of the tube billet in non-oxidizing conditions.

3. A method according to claim 1, comprising providing the non-oxidizing conditions by means of a protective gas chamber which contains protective gas.

4. A method according to claim 1, comprising cold working the tube billet in the first rolling station.

5. A method according to claim 1, comprising reducing the wall thickness of the tube billet in the second rolling station.

6. A method according to claim 1, comprising reducing the wall thickness of the tube billet about 50–70% in the second rolling station.

7. A method according to claim 1, wherein the diameter of the tube billet remains essentially constant in the second rolling station.

8. A method according to claim 1, comprising reducing the diameter of the tube billet in the second rolling station.

9. A method according to claim 1, comprising increasing the diameter of the tube billet in the second rolling Station.

10. A method according to claim 1, comprising carrying out several successive rolling operations at the second rolling station.

11. A method according to claim 1, comprising working the tube billet by planetary rolling at the second rolling station.

12. A method according to claim 1, comprising working the tube billet by planetary rolling at the second rolling station.

13. A method according to claim 1, wherein the tube billet is a continuously cast billet.

14. A method according to claim 1, comprising adjusting the temperature of the tube billet when necessary.

15. An apparatus for working a tube billet by rolling, said apparatus comprising:

first and second rolling arrangements, wherein the second rolling arrangement is downstream of the first rolling arrangement with respect to a feeding direction of the tube and the second rolling arrangement is so located relative to the first rolling arrangement that simultaneously a first length segment of the tube billet is located in the first rolling arrangement and a second length segment of the tube billet is located in the second rolling arrangement and a length segment of the tube billet that leaves the first rolling arrangement substantially immediately enters the second rolling arrangement, wherein the first rolling arrangement comprises a planetary rolling arrangement including at least one conical roll element for performing a first working step and the second rolling arrangement performs at least one second working step, and means for creating non-oxidizing conditions at least at the first and second rolling arrangements.

16. An apparatus according to claim 15, wherein the means for creating non-oxidizing condition comprise a protective gas chamber for protecting the tube billet.

17. An apparatus according to claim 16, wherein the protective gas chamber surrounds the first and second rolling arrangements and the space provided therebetween at least in the vicinity of the tube billet.

18. An apparatus according to claim 15, wherein the conical roll element of the first rolling arrangement of greater diameter on the input side than on the output side.

19. An apparatus according to claim 15, wherein the conical roll element of the first rolling arrangement of greater diameter on the output side than on the tube billet input side.

20. An apparatus according to claim 15, wherein the first rolling arrangement is a planetary including at least three conical roll elements.

21. An apparatus according to claim 15, comprising at least one other planetary mill.

22. An apparatus according to claim 15, wherein at least one roll of the second rolling arrangement has an axis of rotation that is inclined to with the longitudinal axis of the tube billet.

23. An apparatus according to claim 15, wherein at least one roll of the second rolling arrangement has an axis of rotation that is parallel with the longitudinal axis of the tube billet.

24. An apparatus according to claim 15, comprising at least one mandrel element.

* * * * *